US011118399B2

(12) United States Patent
Bright

(10) Patent No.: US 11,118,399 B2
(45) Date of Patent: Sep. 14, 2021

(54) FRAME

(71) Applicant: Bright Structures Limited, Exeter (GB)

(72) Inventor: Stephen Bright, Exeter (GB)

(73) Assignee: BRIGHT STRUCTURES LIMITED, Exeter (GB)

( * ) Notice: Subject to any disclaimer, the term of this patent is extended or adjusted under 35 U.S.C. 154(b) by 282 days.

(21) Appl. No.: 16/379,500

(22) Filed: Apr. 9, 2019

(65) Prior Publication Data

US 2019/0309573 A1 Oct. 10, 2019

(30) Foreign Application Priority Data

Apr. 10, 2018 (GB) ..... 1805937

(51) Int. Cl.
*E06C 7/10* (2006.01)
*E06C 1/04* (2006.01)

(52) U.S. Cl.
CPC . *E06C 7/10* (2013.01); *E06C 1/04* (2013.01)

(58) Field of Classification Search
CPC ..... E06C 1/04; E06C 1/06; E06C 1/08; E06C 7/10
See application file for complete search history.

(56) References Cited

U.S. PATENT DOCUMENTS 976,074 A * 11/1910 Hartman ..... E06C 1/32 182/24
4,498,263 A * 2/1985 Bocker ..... E06C 7/10 52/223.12
2008/0210906 A1 9/2008 Berhbuegler
2012/0175188 A1* 7/2012 Xu ..... E06C 7/488 182/107
2016/0265278 A1* 9/2016 Jeffrey ..... E06C 7/10
2018/0100351 A1* 4/2018 Bright ..... E06C 7/50
2019/0024331 A1* 1/2019 Bright ..... E01D 21/06

FOREIGN PATENT DOCUMENTS

CN 103510841 A 1/2014

OTHER PUBLICATIONS

Patents Act 1977: Search Reports Under Section 17(5) and Section 17, United Kingdom Intellectual Property Office (UKIPO), Great Britain Patent Application Serial No. GB1805937.8, dated Jan. 17, 2019.

* cited by examiner

*Primary Examiner* — Alvin C Chin-Shue
*Assistant Examiner* — Shiref M Mekhaeil
(74) *Attorney, Agent, or Firm* — Reichel Stohry Dean LLP; Mark C. Reichel; Natalie J. Dean

(57) ABSTRACT

A frame releasably fixable to a ladder for attaching a mast to the ladder, the frame comprising two sub-frames, each sub-frame comprising two legs, each leg including a stud receiving notch and a support bar at one end thereof, the stud receiving notch for limiting rotation of the sub-frame relative to the ladder, with the frame in place on a ladder and the stud receiving notch engaged with a stud provided on the side of the ladder, the support bar for resting on a surface of the ladder, in use, the two sub-frames releasably attachable to one another at the other end thereof to form a socket for receiving the structural mast.

16 Claims, 8 Drawing Sheets

FRAME

PRIORITY

The present application is related to, and claims the priority benefit of, Great Britain Patent Application Serial No. GB1805937.8 (1805937.8), filed Apr. 10, 2018, the contents of which are incorporated herein directly and by reference in their entirety.

BACKGROUND

The present invention relates generally to a frame for use with ladders in order to attach structural members to them and finds particular, although not exclusive, utility in stiffening ladders for use as bridges or conveyors.

It is known to use ladders as bridges. However, bridges may bend in the middle with undue weight applied to them and as such the ladder has to be stiffened by the addition of ropes and other structural support means such as masts to which ropes may be attached, or pass-over, or around. It is often desired to erect such bridges from kits of parts in as little time as possible. Accordingly, it is desirable to have components in the kit of parts which allow for simple assembly.

BRIEF SUMMARY

In a first aspect, the present invention provides a frame releasably fixable to a ladder for attaching a mast to the ladder, the frame comprising two sub-frames, each sub-frame comprising two legs, each leg including a stud receiving notch and a support bar at one end thereof, the stud receiving notch for limiting rotation of the sub-frame relative to the ladder, with the frame in place on a ladder and the stud receiving notch engaged with a stud provided on a side of the ladder, the support bar for resting on a surface of the ladder, the two sub-frames releasably attachable to one another to form a socket for receiving the mast.

The ladder may be of the type comprising two stiles with rungs in between.

The term "surface of the ladder" may refer to the side or top or bottom face of the stile of the ladder.

The sub-frames are each attachable to the ladder by offering-up the legs (the ends with the stud receiving notches) to the ladder and rotating each sub-frame such that the ends of the legs rest underneath rungs of the ladder and the notches engage with studs on the ladder. The ends of each sub-frame meet together to form the socket.

The studs and stud receiving notches locate the sub-frames relative to the ladder and prevent over-rotation of each sub-frame. The support bars may determine the mounting depth of the sub-frames onto the supporting ladders, and may transfer, at least partially, any vertical load imparted onto the ladder into the mast, and any attached rope tensioning system.

The two sub-frames may be releasably attachable to one another via a removable collar which is arranged to fit around the socket.

The support bar, included at the end of each leg, may be cylindrical, although other shapes such as rectangular are contemplated.

The end of each leg may include a support bar, and each support bar may include a central portion having a first width and a first length, and an outer portion at each end of the central portion having a second width, the second width being greater than the first width, the outer portions arranged to locate the support bar on a surface of a ladder in use to limit movement between the support bar and the surface of the ladder.

The support bar may be similar to the shape of a cotton-reel such that the body of the reel is the central portion and the two outer portions are flanges which locate the support bar on a stile which fits between the two flanges. In this respect, the first length may be arranged to be approximately the same width as a standard ladder stile.

The support bar may be considered to be a force transfer member in that it transfers force from the mast to the ladder.

The stud receiving notches on each sub-frame may be arranged to receive studs arranged at similar linear positions along the longitudinal length of the ladder, in use. In other words, each sub-frame may be symmetrically positioned on the ladder in use.

Each sub-frame may include a socket portion, the two socket portions together forming the socket. For instance, the socket may be divided into two equal, or unequal portions which together form the socket. For example, each portion may be a half a cylinder or half a rectangle.

Each sub-frame may further comprise a stabilising bar arranged between and attached to each leg adjacent to the stud receiving notches. This may improve the structural rigidity of the sub-frame.

The stabilising bar may extend through each leg to form the support bars. In this regard, each leg may fit inside the stiles of the ladder such that the support bars are arranged on outer opposite surface of each leg.

The socket may be arranged to be mid-way between the two sub-frames. The two sub-frames may be symmetrical. In use, the socket may be arranged above the ladder.

Each leg may be arranged to extend beyond the stud receiving notch such that, in use with a stud received in the stud receiving notch, the distal end of each leg may rest against a rung of the ladder.

Each leg may comprise two rectilinear sections with a bend therebetween. The legs may comprise tubing having a rectangular or circular cross-section.

Each sub-frame may comprise sleeves arranged on one rectilinear section of each leg, the sleeve comprising a flange forming the stud receiving notch. Alternatively, the stud receiving notch may be formed in the side of the rectilinear section.

The sleeve may include a spacer arranged to space the sleeve away from the inside of the ladder stiles in use. This may take the form of a lug.

The frame may further comprise a collar arranged over the socket to hold the two sub-frames together. The collar may be an open rectangle or cylinder of slightly greater dimensions than the outside of the socket.

The socket and/or collar may include fixing means for releasably fixing the mast therein. These may comprise sprung pins. The frame may further comprise a rope support inserted into the socket, the rope support including any one or more of a curved surface for cords to pass over, holes for clipping carabiners into, and an upstand for at last partially wrapping cords around. In this way, ropes or other cord-like elements may be attached to the frame, or pass over, or around, it. Such ropes are attachable, in use, to points on the ladder so that, with the frame, they may act to stiffen the ladder. The rope support may be considered to be a rope management member.

Alternatively, the frame may include a mast received in the socket. Cords may be attachable to the mast for stiffening a ladder.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
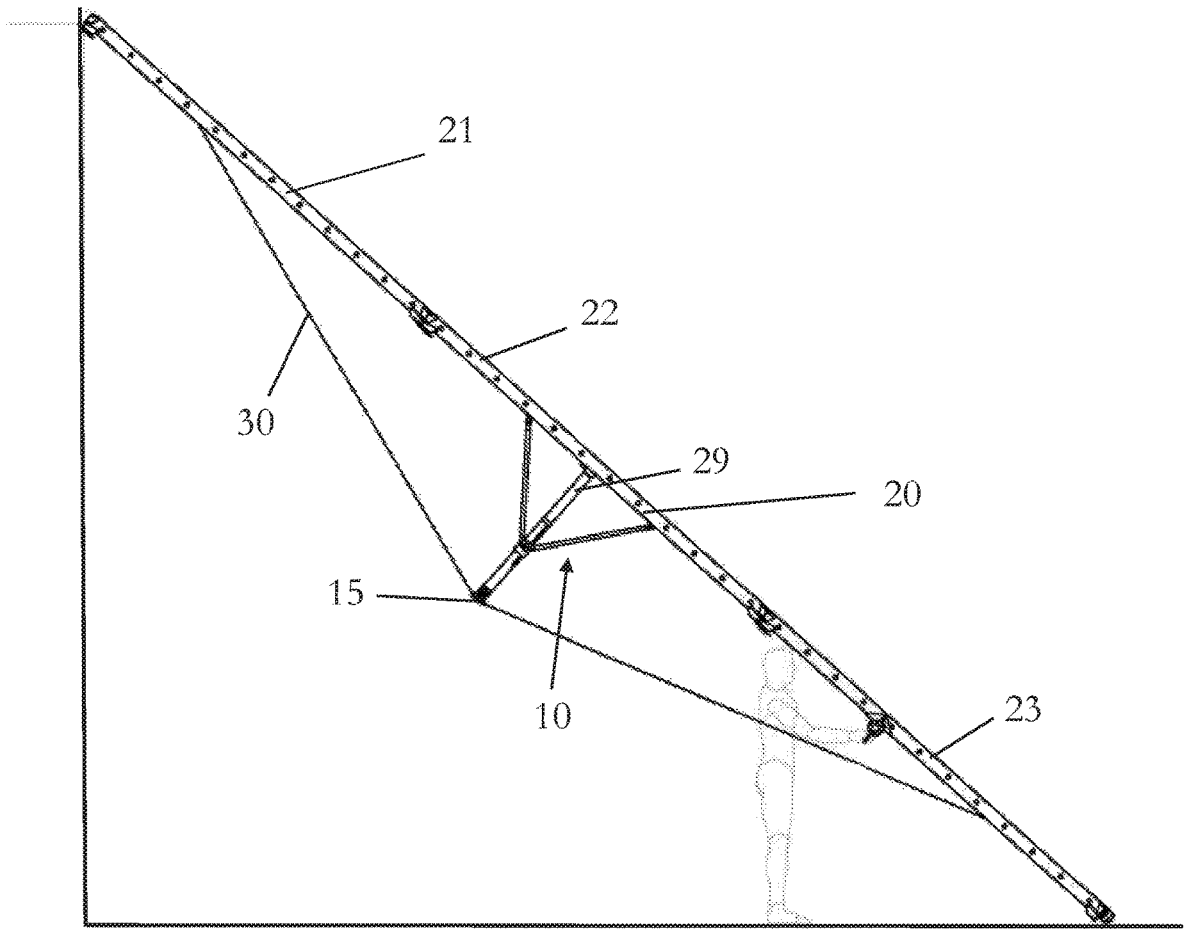
FIGS. 1 and 2 are elevational side views of a frame attached to a ladder.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

In FIG. 1, three ladders sections 21, 22, 23 have been connected end-to-end to form one long ladder 20. This long ladder is shown leant-up against an object (not shown) such as a building such that a lower end rests on the ground and the upper end rests against the building.

The ladder 20 includes a frame 10 attached centrally to the longitudinal length thereof. The frame 10 is attached to the single central ladder. The frame has an apex 15 out of the plane in which the ladder's rungs and stiles lie. In this case, the apex 15 is shown beneath the ladder 20. A rope 30 is shown with one end attached to the ladder towards its upper end and one end attached to the ladder towards its lower end.

The rope 30 extends over the apex 15. With the rope pulled taught the ladder is stiffened by its presence.

A mast 29 is indicated in broken lines extending from the ladder up to apex 15. This is to show how a mast may be installed although it may not be required in the example shown in this figure. In other examples, the mast 29 may extend through apex 15.

Figure 2:
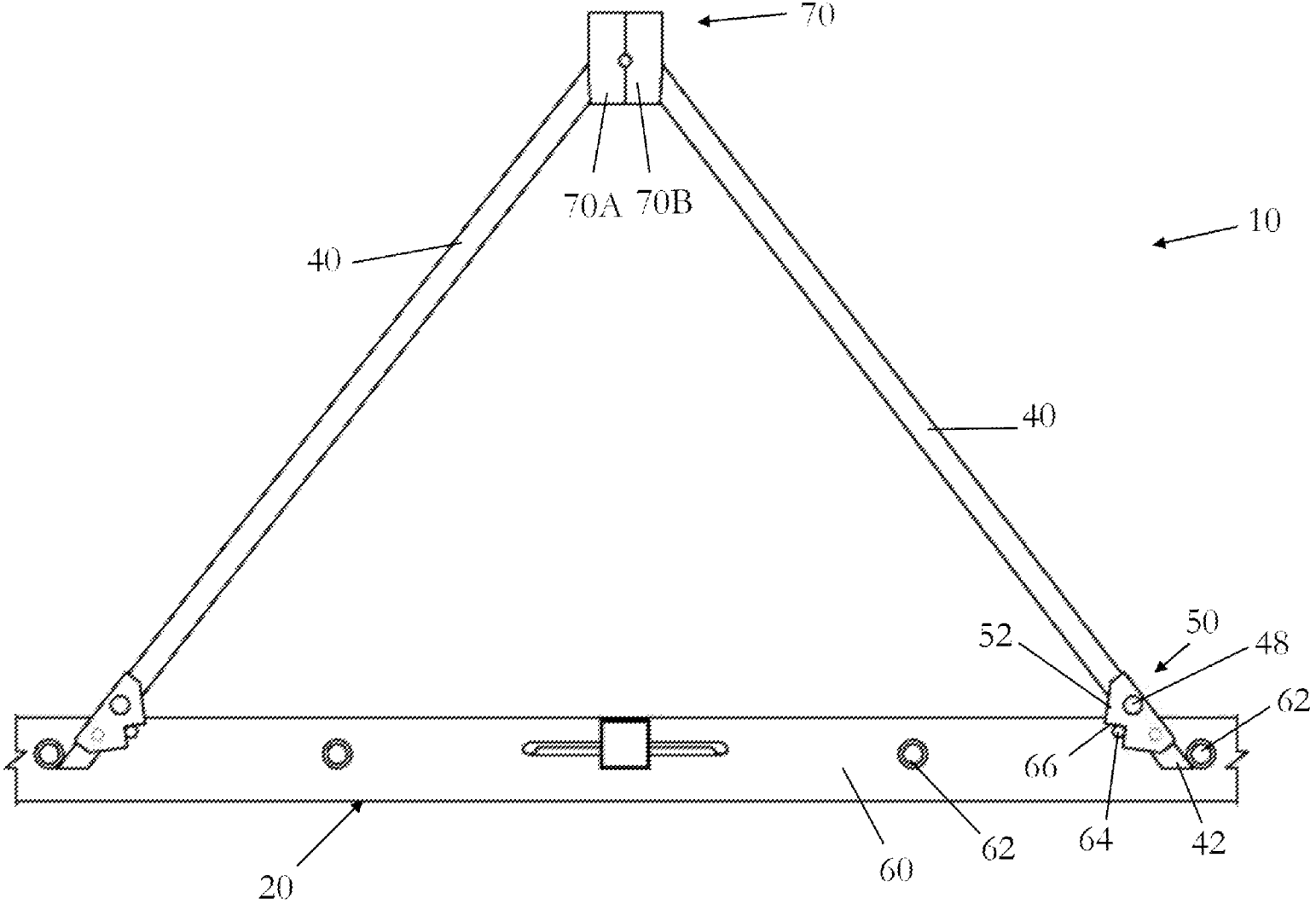

A side view of a frame is shown in FIG. 2 having two legs arranged in a Roman letter "A" shape such that the apex is above the ladder 20 on which it is arranged.

Figure 3:
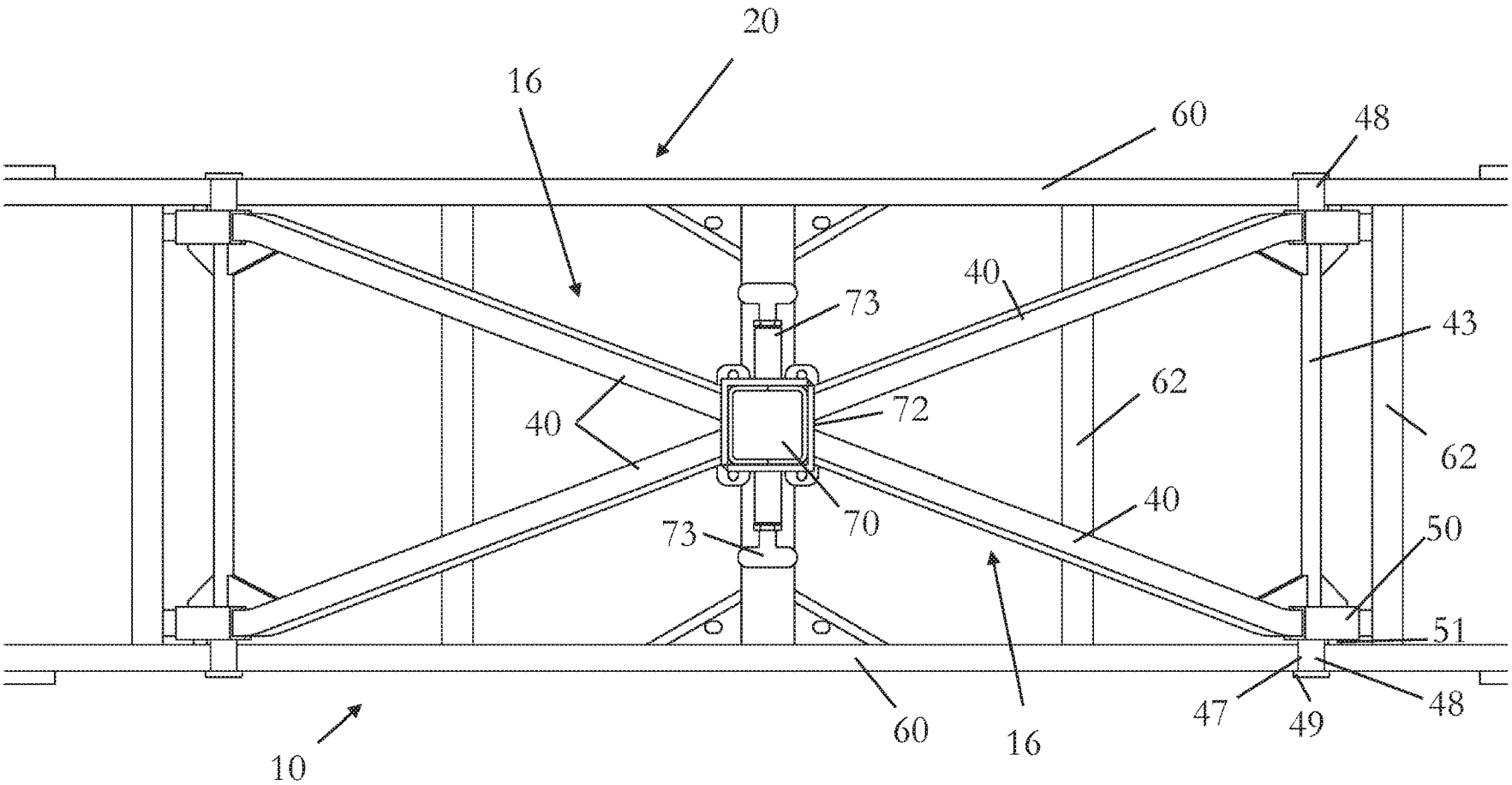
FIG. 3 is a plan view of a frame attached to a ladder.

Another two legs are arranged behind the first visible two as shown in FIG. 3. These additional two legs are not visible due to the presence of the front two legs 40.

At the upper ends of each leg a half-socket 70A, 70B is arranged. With the two legs in place on the ladder, a full socket 70 is created.

The ladder 20 is shown horizontally beneath the frame 10. It comprises two stiles 60, although only one is visible. The stiles have a rectangular cross-section with an outer side surface visible. Also present are an inner side surface opposite to the outer side surface, a top surface which connects the two side surfaces and a bottom surface opposite the top surface.

The ladder 20 includes rungs 62 connecting the inner side surfaces. Studs 64 are provided on the inner side surfaces in the form of projecting lugs.

Each leg 40, which has a recti-linear form as viewed from the side of the ladder, has a sleeve 50 arranged towards, and around, its lower end. The sleeve fits snugly around the leg. It includes a flange 52 which projects away from the longitudinal length in a plane parallel to the plane in which the longitudinal lengths of the stiles lie, said plane being perpendicular to the plane in which the rungs longitudinal lengths lie.

Each flange 52 includes a notch 66 arranged and shaped to accept a stud 64.

In use, the leg 40 is offered up to the ladder 20 with its longitudinal length being approximately perpendicular to the ladder's longitudinal length. The lower end of the leg 42 is inserted between rungs and adjacent a stud 64. The leg 40 is then rotated such that the top swings towards the ladder so that the notch 66 engages the stud 64. The lower end 42 of the leg 40 will contact the adjacent rung 62 such that the leg is held in place.

A support bar 48 is arranged on the sleeve 50 such that it projects over the top of the stile 60. With the leg 40 correctly installed (such that the stud 64 is engaged in the notch 66, and the lower end 42 of the leg is abutted against the rung 62), the support bar 48 rests on top of the stile 60.

Another leg 40 is installed adjacent to the first leg 40 but rotated in the opposite direction such that together they form an "A" shape and meet together at the top 70 as shown.

A plan view of a frame 10 attached to a ladder 20 is shown in FIG. 3. The frame 10 is seen to comprise four legs 40. The right hand two legs are joined together at the top to form a socket 70 and by a stabilising bar 43 which extends between each lower leg. The left hand two legs are likewise joined together. This creates two sub-frames 16.

A collar 72 is shown surrounding the socket 70. This collar 72 is in the form of a hollow rectangle which slides over the two socket halves to lock them together. Two sprung bolts 73 are included, one either side of the collar 72. These may be arranged such that the bolts project through holes in the collar and socket to releasably attach a mast or other structural member in the socket.

Instead of a hollow rectangle the two halves forming the socket may be held together with pins. The sockets may be shaped to interlock in longitudinal and lateral directions to secure themselves in position against one another in the event the mast is omitted.

Also shown are spacers 51 arranged on the side of the sleeves 50 and arranged to sit between the sleeves 50 and inner side surface of the stiles 60. These maintain a relatively small distance between the sleeves and the stiles. The spacers are designed to have a 5 mm thickness (although other thicknesses are contemplated). These spacers allow for manufacturing tolerances such as if the ladders are fabricated slightly narrow, or the sub-frames slightly wide. It is possible to file-down the spacers until the correct (tight) fit is achieved.

The construction of the support bars 48 is shown in this drawing in that it is seen how they comprise an outer section 49 having a wider width than the central section 47. The central section 47 rests on the stile 60 and the outer section 49 projects down the outer side surface of the stile 60.

In this example, the stabilising bar 43 extends through the sleeve 50 and the lower end of the leg to protrude outwardly each side thus forming the support bar 48.

The lower end of the legs can be seen to pass under the rungs 62.

The arrangement of the two sub-frames creates an "X" shape in plan view which is structurally strong as it includes several triangular shapes formed by the legs 40.

Figure 4:
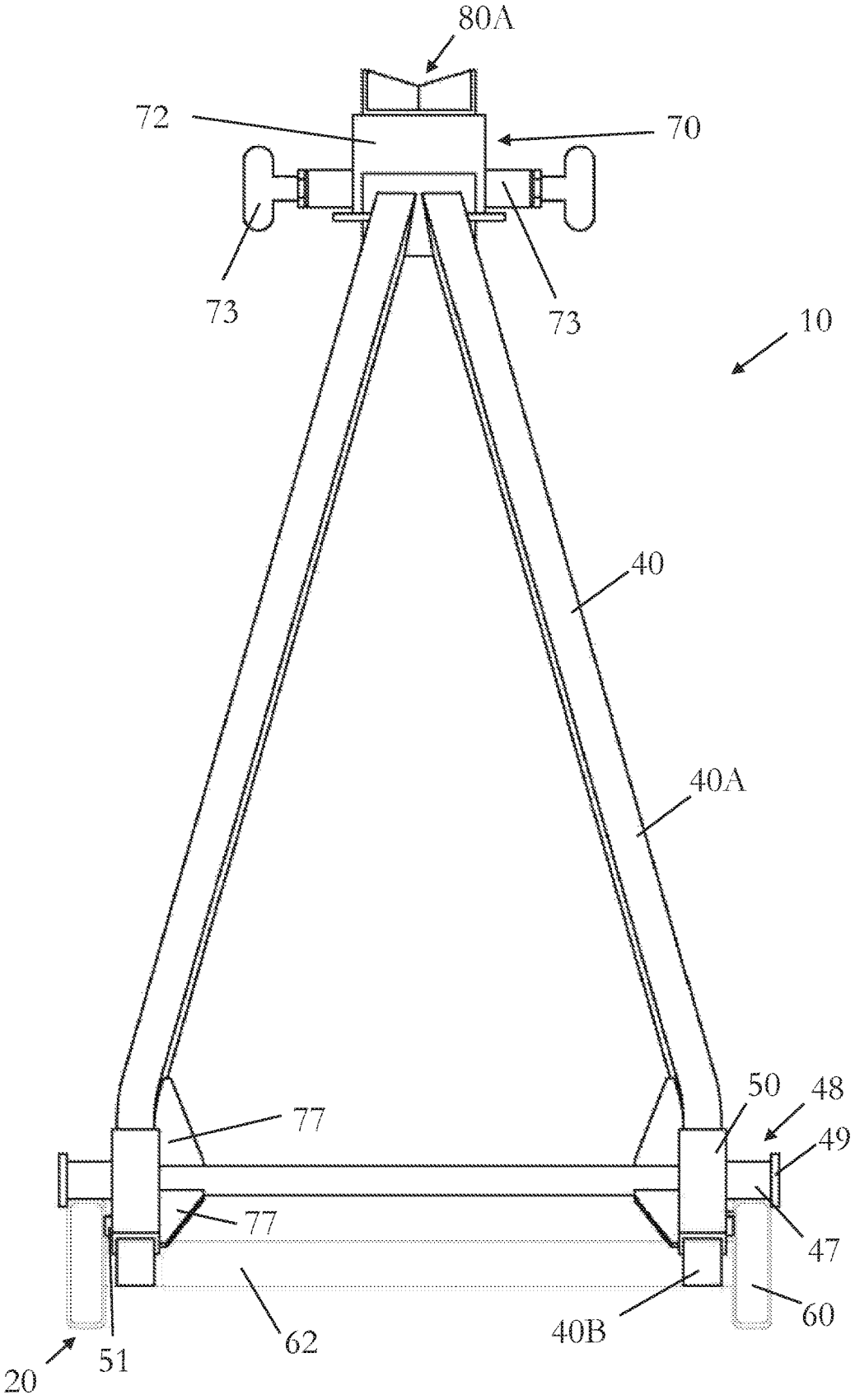
FIG. 4 is an elevational view of a frame attached to a ladder.

FIG. 4 is an elevational view of the frame 10 looking along the longitudinal length of the ladder 20. The support bars 48 are visible resting on top of the stiles 60 with their wider ends 49 arranged outside the stiles. The spacers 51 are also visible between the sleeves 50 and the inner side surfaces of the stiles 60.

The legs 40 have two sections, an upper rectilinear section 40A and a lower rectilinear section 40B. The bores of the two sections are not co-axial. Instead there is a bend just above where the leg approaches the stile. The sleeves 50 are located on the lower sections 40B.

Gussets 77 are provided between the legs 40 and the sleeve 50 to improve the strength of the frame 10.

The collar 72 is shown at the apex of the frame including the two previously described sprung bolts 73. A rope support 80 has been inserted into the socket 70. However, it is also contemplated that it might sit around the socket 70 within the collar 72. The rope support 80 comprises a "V" shape recess at its tops within which ropes may lie when fixed over the frame from one side to the other.

Figure 5:
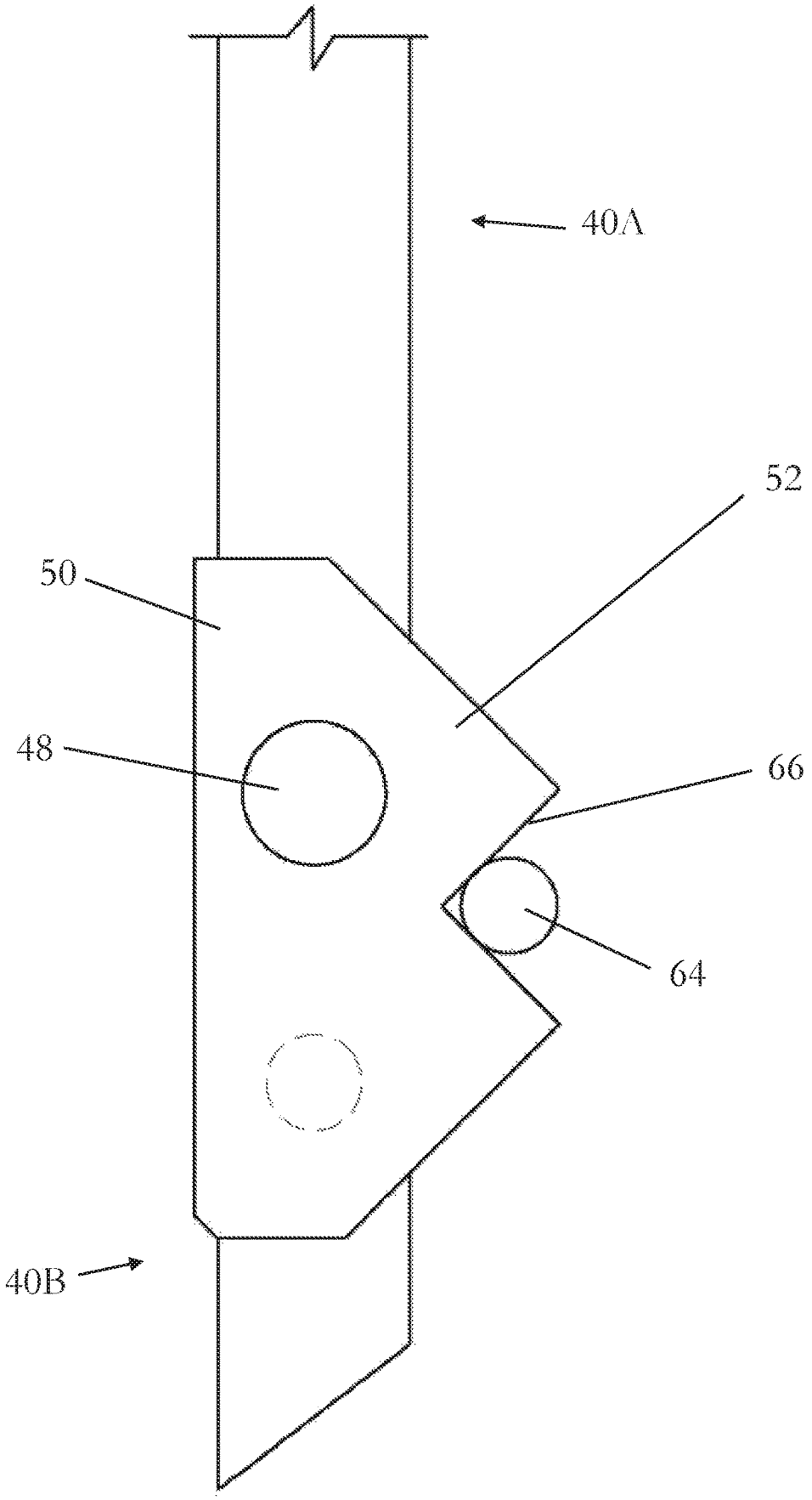
FIGS. 5 and 6 are elevational close-up views of part of a frame.

A closer view of the lower leg section 40B is shown in FIG. 5 where the sleeve 50 can be seen to include a flange 52 with a "V" shape notch 66 provided in it to accept a stud 64. The support bar 48 is visible on the side of the sleeve 50. The view shown is one looking from the side of the ladder in a similar manner to that shown in FIG. 2.

Figure 6:
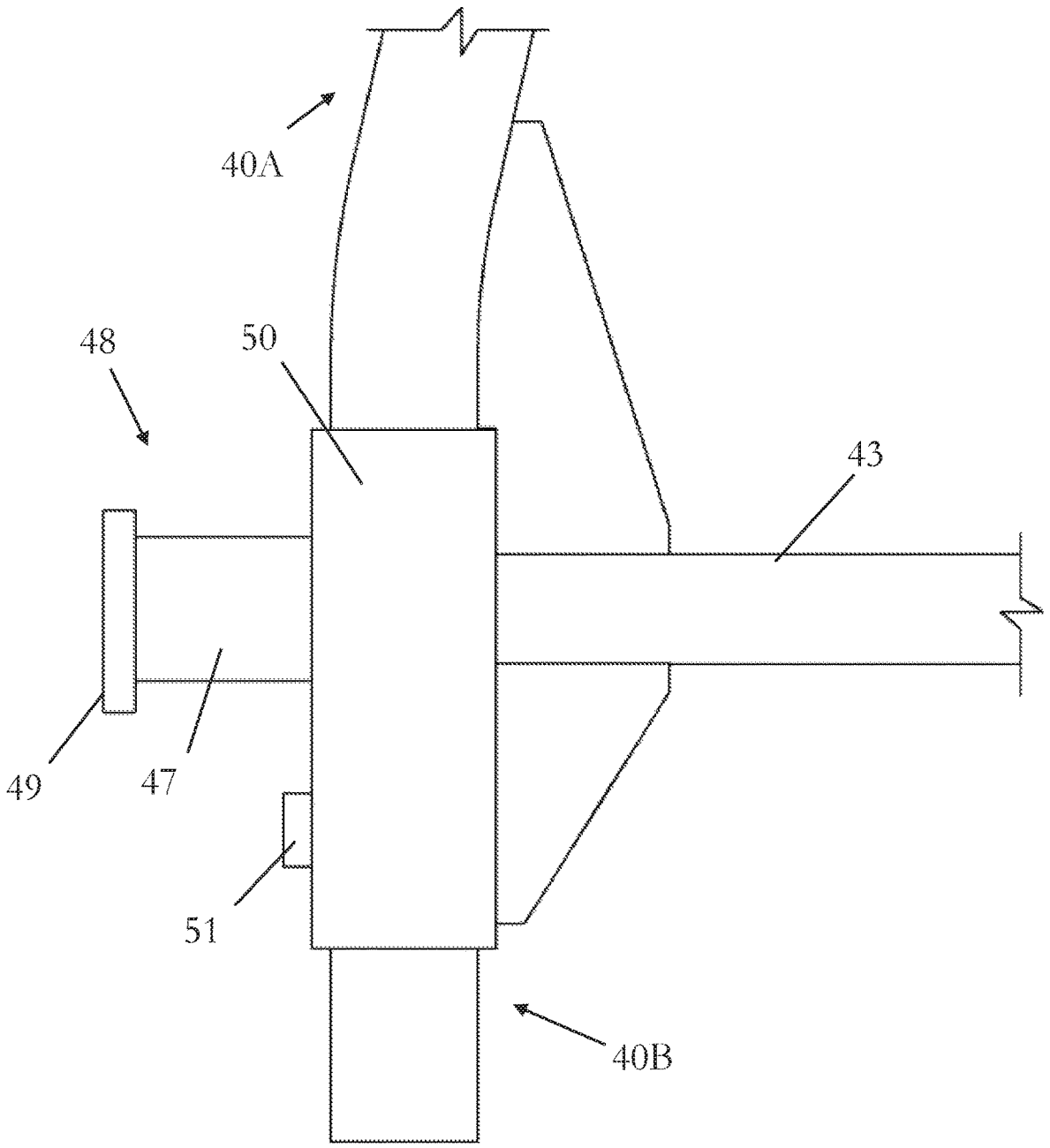

FIG. 6 shows a closer view of the lower leg section 40B and the sleeve 50 looking along the length of the ladder. The support bar 48 is visible together with the stabilising bar 43.

Figure 7:
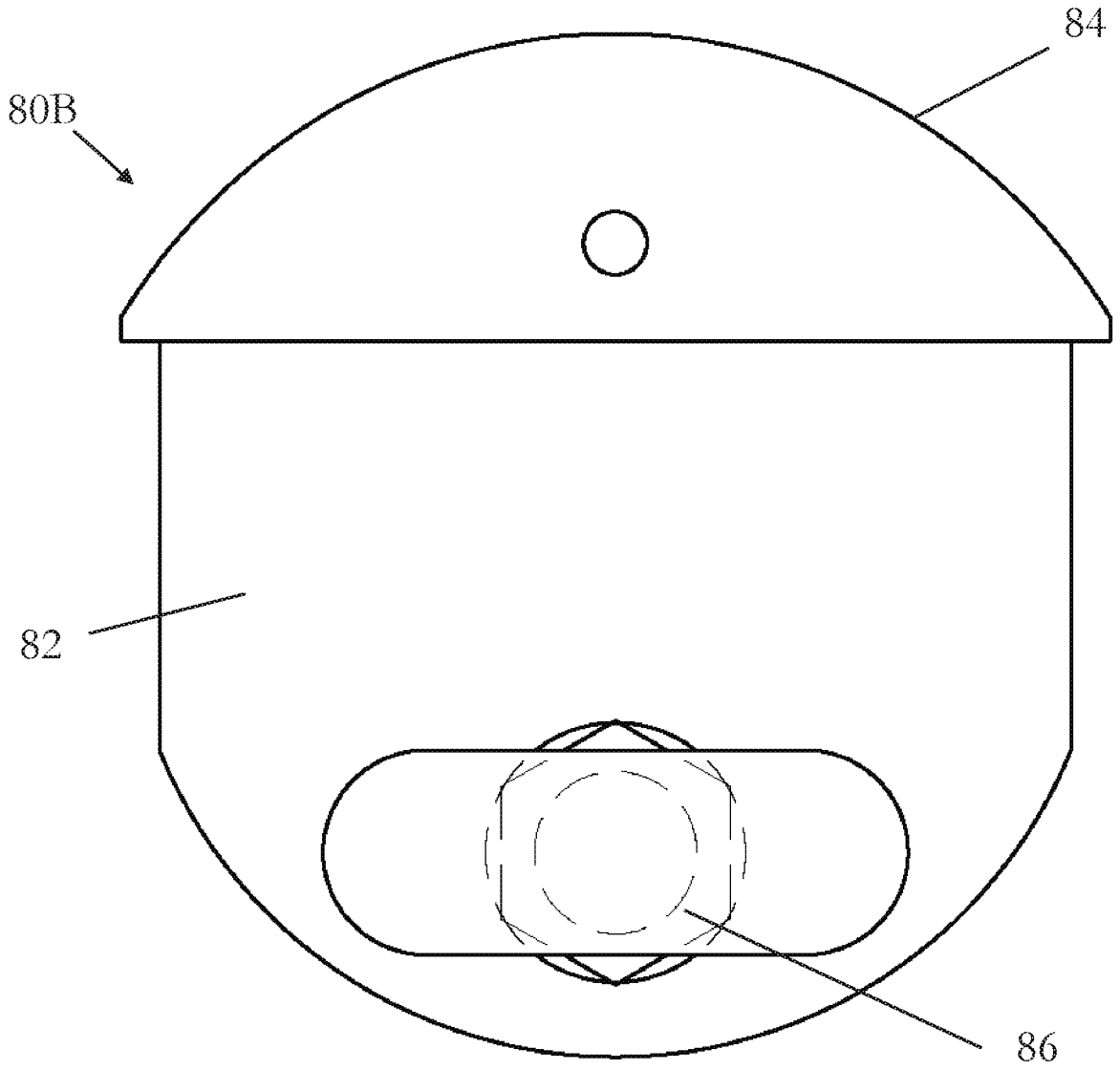
FIGS. 7 and 8 are views of rope supports.

In FIG. 7, a closer view of the rope support 80B is shown in elevation. It comprises a body 82 which is shaped to fit over the socket 70 at the top of the frame 10. Above the body is a dome shape element 84 which, when the rope support is fitted over the socket 70, sits above the socket 70. The rope support 80B may be fixed in place with bolts via hole 86 in the body and a corresponding hole in the socket 70.

The rope support allows ropes to pass smoothly over the top of the frame 10 without being damaged by sharp edges.

Figure 8:
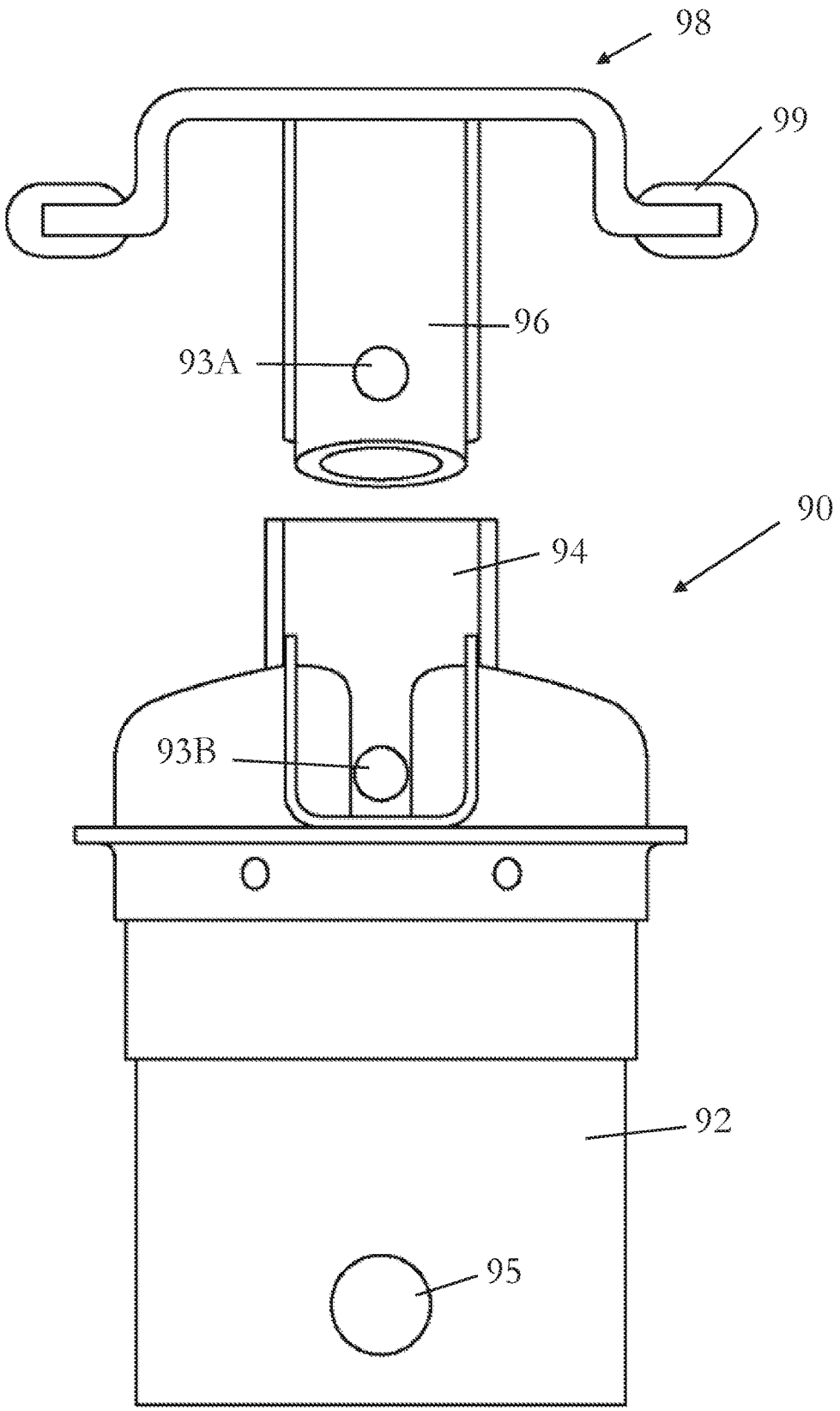

In FIG. 8 an alternative rope support 90 is shown. It has a body 92 which is insertable into the socket 70. This rope support 90 includes sockets 94 arranged to receive spigots 96 of an upper rope support 98. In this case, the upper rope support 98 includes two brackets 99 which project outwardly to either side of the top of the spigot 96 which can be used to connect ladder stiffening ropes terminating at the top of the upper rope support. In use, ropes may be wound around the sockets 94 so that a single rope may be attached to a ladder at both ends at points adjacent one another on the ladder with the loop passing around a socket 94. The upper rope support 98 forms a removable cap to secure the ropes in place and provide attachment points 99 for additional ropes.

Other upper rope supports 98 may be provided with different arrangements for receiving cables, ropes and other structural support elements. Each upper rope support 98 may have one or more spigots 96 to fit into the one or more sockets 94.

The rope support 90 may be affixed to the socket 70 via a pin passing through hole 95 and a co-axial hole provided in the socket and/or collar 70.

The upper rope support 98 may be affixed to the (lower) rope support 90 via pins fitted through co-axial holes 93A, 93B.

Although the terms "rope" and "cord" have been used herein it will be understood that other inextensible, linear, flexible elements are suitable.

The invention claimed is:

1. A frame releasably fixable to a ladder, for attaching a mast to the ladder, the frame comprising two sub-frames, each sub-frame comprising two legs, wherein one end of each leg includes a stud receiving notch and a support bar, wherein the frame is fixable to the ladder by each stud receiving notch being configured to engage with a respective stud arranged on the side of the ladder, such that with the frame fixed to the ladder the rotation of the frame relative to the ladder is limited, and wherein with the frame fixed to the ladder the support bar is arranged to rest on a surface of the ladder, and wherein with the frame fixed to the ladder the two sub-frames are releasably attached to one another to form a socket for receiving the mast.

2. The frame of claim 1, wherein the two sub-frames are releasably attachable to one another via a removable collar which is arranged to fit around the socket.

3. The frame of claim 1, wherein the support bar, included at one end of each leg, is cylindrical.

4. The frame of claim 1, wherein the support bar of each leg includes a central portion having a first width and a first length, and an outer portion at each end of the central portion having a second width, the second width being greater than the first width, the outer portions arranged to locate the support bar, in use on the surface of the ladder, to limit movement between the support bar and the surface of the ladder.

5. The frame of claim 1, wherein each sub-frame includes a socket portion, the two socket portions together forming the socket.

6. The frame of claim 5, wherein the socket is arranged to be mid-way between the two sub-frames.

7. The frame of claim 5, wherein the socket includes sprung pins for releasably fixing a mast therein.

8. The frame of claim 1, wherein each sub-frame further comprises a stabilising bar arranged between and attached to each leg adjacent to the stud receiving notches.

9. The frame of claim 8, wherein the stabilising bar extends through each leg to form the support bars.

10. The frame of claim 1, wherein each leg is arranged to extend beyond the stud receiving notch such that, in use with a stud received in the stud receiving notch, the distal end of each leg rests against a rung of the ladder.

11. The frame of claim 1, wherein each leg comprises two rectilinear sections with a bend therebetween.

12. The frame of claim 11, wherein a sleeve is arranged on one rectilinear section, the sleeve comprising a flange forming the stud receiving notch.

13. The frame of claim 12, wherein the sleeve includes a spacer arranged to space the sleeve away from an inside of the ladder stiles in use.

14. The frame of claim 1, further comprising a rope support inserted into the socket, the rope support including any one or more of a curved surface for cords to pass over, holes for clipping carabiners into, and an upstand for at last partially wrapping cords around.

15. The frame of claim 1, including a mast, to which cords are attachable for stiffening a ladder, received in the socket.

16. A frame releasably fixed to a ladder, the frame comprising two sub-frames, each sub-frame comprising two legs, wherein one end of each leg includes a stud receiving notch and a support bar and the ladder includes studs on each side for engaging with the receiving notches, wherein the stud receiving notch of each leg is engaged with each respective stud to limit rotation of the sub-frame relative to the ladder, wherein the support bar rests on a surface of the ladder, and wherein the two sub-frames are releasably attached to one another to form a socket with a mast received in said socket.

* * * * *